US007473327B2

(12) United States Patent
Takase et al.

(10) Patent No.: US 7,473,327 B2
(45) **Date of Patent: *Jan. 6, 2009**

(54) WEAR-RESISTANT ALUMINUM ALLOY EXCELLENT IN CAULKING PROPERTY AND EXTRUDED PRODUCT MADE THEREOF

(75) Inventors: Nobuyuki Takase, Uozu (JP); Nobuyuki Higashi, Takaoka (JP); Kazuhiro Nishikawa, Takaoka (JP)

(73) Assignee: Aisin Keikinzoku Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/812,406

(22) Filed: Mar. 26, 2004

(65) Prior Publication Data

US 2004/0223869 A1 Nov. 11, 2004

Related U.S. Application Data

(63) Continuation of application No. PCT/JP02/01885, filed on Feb. 28, 2002.

(51) Int. Cl.
*C22C 21/02* (2006.01)

(52) U.S. Cl. ..... 148/417; 420/546

(58) Field of Classification Search ..... 148/417; 420/534, 535, 546, 544

See application file for complete search history.

(56) References Cited

U.S. PATENT DOCUMENTS

| | | | | |
|---|---|---|---|---|
| 4,959,195 | A | 9/1990 | Kusui et al. | 419/67 |
| 6,607,615 | B1 * | 8/2003 | Bekki et al. | 148/439 |
| 7,175,719 | B2 * | 2/2007 | Higashi et al. | 148/440 |

FOREIGN PATENT DOCUMENTS

| | | | |
|---|---|---|---|
| EP | 1 108 798 | A2 | 6/2001 |
| EP | 1 108 798 | A3 | 12/2001 |
| JP | 05-311306 | | 11/1993 |
| JP | 09-176769 | | 7/1997 |
| JP | 09176769 | A * | 7/1997 |
| JP | 09-249931 | | 9/1997 |
| JP | 10-265918 | | 10/1998 |
| JP | 2002-47524 | | 2/2002 |

* cited by examiner

*Primary Examiner*—Roy King
*Assistant Examiner*—Janelle Morillo
(74) *Attorney, Agent, or Firm*—Harness, Dickey & Pierce, P.L.C.

(57) ABSTRACT

A wear-resistant aluminum alloy improved in wear resistance (or viscosity), including: 0.1 to 0.39 wt % of Mg, 3.0 to 6.0 wt % of Si, 0.01 to 0.5 wt % of Cu, 0.01 to 0.5 wt % of Fe, 0.01 to 0.5 wt % of Mn, 0.01 to 0.5 wt % of Cr, and the remainder being Al and unavoidable impurities; and an extruded product using the aluminum alloy.

2 Claims, 8 Drawing Sheets

| | NO. | ALLOYS | COMPONENTS(%) | | | | | | | |
|---|---|---|---|---|---|---|---|---|---|---|
| | | | Si | Fe | Cu | Ti | Mn | Mg | Cr | Zn |
| ALLOYS OF THE INVENTION | 1 | A | 4.77 | 0.26 | 0.05 | 0.04 | 0.1 | 0.3 | 0.1 | 0.01 |
| | 2 | B | 3.82 | 0.25 | 0.01 | 0.03 | 0.1 | 0.2 | 0.1 | 0 |
| | 3 | C | 4.86 | 0.36 | 0.15 | 0.03 | 0.1 | 0.46 | 0.1 | 0 |
| | 4 | D | 4.59 | 0.29 | 0.15 | 0.03 | 0.1 | 0.37 | 0.1 | 0 |
| | 5 | E | 4.11 | 0.25 | 0.07 | 0.03 | 0.05 | 0.28 | 0.05 | 0 |
| | 6 | F | 4.93 | 0.36 | 0.19 | 0.03 | 0.15 | 0.39 | 0.14 | 0 |
| | 7 | G | 3.85 | 0.25 | 0.21 | 0.03 | 0.46 | 0.25 | 0.1 | 0.01 |
| | 8 | H | 4.10 | 0.26 | 0.49 | 0.03 | 0.12 | 0.3 | 0.2 | 0.01 |
| | 9 | I | 4.53 | 0.30 | 0.32 | 0.02 | 0.15 | 0.31 | 0.45 | 0.01 |
| COMPARATIVE EXAMPLE | 10 | J | 4.32 | 0.2 | 1.02 | 0.03 | 0.14 | 0.61 | 0.13 | 0.02 |

FIG. 1

| | NO. | ALLOYS | COMPONENTS(%) | | | | | | | |
|---|---|---|---|---|---|---|---|---|---|---|
| | | | Si | Fe | Cu | Ti | Mn | Mg | Cr | Zn |
| ALLOYS OF THE INVENTION | 1 | A | 4.77 | 0.26 | 0.05 | 0.04 | 0.1 | 0.3 | 0.1 | 0.01 |
| | 2 | B | 3.82 | 0.25 | 0.01 | 0.03 | 0.1 | 0.2 | 0.1 | 0 |
| | 3 | C | 4.86 | 0.36 | 0.15 | 0.03 | 0.1 | 0.46 | 0.1 | 0 |
| | 4 | D | 4.59 | 0.29 | 0.15 | 0.03 | 0.1 | 0.37 | 0.1 | 0 |
| | 5 | E | 4.11 | 0.25 | 0.07 | 0.03 | 0.05 | 0.28 | 0.05 | 0 |
| | 6 | F | 4.93 | 0.36 | 0.19 | 0.03 | 0.15 | 0.39 | 0.14 | 0 |
| | 7 | G | 3.85 | 0.25 | 0.21 | 0.03 | 0.46 | 0.25 | 0.1 | 0.01 |
| | 8 | H | 4.10 | 0.26 | 0.49 | 0.03 | 0.12 | 0.3 | 0.2 | 0.01 |
| | 9 | I | 4.53 | 0.30 | 0.32 | 0.02 | 0.15 | 0.31 | 0.45 | 0.01 |
| COMPARATIVE EXAMPLE | 10 | J | 4.32 | 0.2 | 1.02 | 0.03 | 0.14 | 0.61 | 0.13 | 0.02 |

FIG. 2

| | NO. | ALLOYS | HOMOGE-NIZATION TEMPERATURE (℃) | HOMOGE-NIZATION TIME (h) | BILLET HEATING TEMPERATURE (℃) | EXTRUSION TEMPERATURE (℃) | ARTIFICIAL AGING TEMPERATURE (℃) | ARTIFICIAL AGING TIME (h) |
|---|---|---|---|---|---|---|---|---|
| ALLOYS OF THE INVENTION | 1 | A | 470 | 12 | 470 | 500 | 195 | 5 |
| | 2 | B | 470 | 12 | 470 | 495 | 190 | 6.5 |
| | 3 | C | 470 | 12 | 470 | 500 | 170 | 3 |
| | 4 | D | 510 | 6 | 470 | 500 | 170 | 4 |
| | 5 | E | 510 | 6 | 470 | 495 | 170 | 4 |
| | 6 | F | 510 | 6 | 470 | 500 | 170 | 4 |
| | 7 | G | 490 | 8 | 470 | 500 | 175 | 4 |
| | 8 | H | 490 | 8 | 470 | 500 | 175 | 4 |
| | 9 | I | 490 | 8 | 470 | 500 | 175 | 4 |
| COMPARATIVE EXAMPLE | 10 | J | 470 | 12 | 470 | 500 | 175 | 3 |

FIG. 3

| | NO. | ALLOYS | EXTRUDABILITY (m/min) | HARDNESS | MECHANICAL PROPERTIES | | | COMPRESSIBILITY |
|---|---|---|---|---|---|---|---|---|
| | | | | HRB HARDNESS (SURFACE) | TENSILE STRENGTH (MPa) | YIELD STRENGTH (MPa) | ELONGATION (%) | CRITICAL UPSETTING RATIO (%) |
| ALLOYS OF THE INVENTION | 1 | A | 5 | 51 | 285 | 241 | 10 | 49.2 |
| | 2 | B | 6 | 36 | 269 | 214 | 11 | 51.6 |
| | 3 | C | 5 | 65 | 324 | 270 | 11 | 48.8 |
| | 4 | D | 5 | 56 | 306 | 274 | 12 | 47.2 |
| | 5 | E | 6 | 43 | 265 | 222 | 13 | 53.9 |
| | 6 | F | 5 | 57 | 308 | 270 | 12 | 43.1 |
| | 7 | G | 5 | 44 | 272 | 235 | 11 | 44.5 |
| | 8 | H | 5 | 48 | 279 | 238 | 11 | 49.0 |
| | 9 | I | 5 | 53 | 293 | 256 | 12 | 49.8 |
| COMPARATIVE EXAMPLE | 10 | J | 3 | 64 | 349 | 274 | 11 | 40.0 |

FIG. 4

MULTIPLE REGRESSION ANALYSIS RESULT
(STANDARDIZED PARTIAL REGRESSION COEFFICIENT)

| RESPONSE VARIABLE | EXPLANATORY VARIABLE | | | | | | | |
|---|---|---|---|---|---|---|---|---|
| | Si | Fe | Cu | Ti | Mn | Mg | Cr | Zn |
| TENSILE STRENGTH | — | — | — | -0.07 | — | 0.93 | — | — |
| SURFACE HARDNESS | 0.25 | — | -0.44 | — | — | 1.19 | — | — |
| CRITICAL UPSETTING RATIO | — | — | — | — | -0.79 | -0.26 | — | — |

WEAR-RESISTANT ALUMINUM ALLOY EXCELLENT IN CAULKING PROPERTY AND EXTRUDED PRODUCT MADE THEREOF

CROSS REFERENCE TO RELATED APPLICATION

This application is a continuation of International Application No. PCT/JP02/01885, having an international filing date of Feb. 28, 2002, which designated the United States, the entirety of which is incorporated herein by reference.

BACKGROUND OF THE INVENTION

The present invention relates to a wear-resistant aluminum alloy excellent in caulking properties and an extruded product using the same.

More particularly, the present invention relates to an aluminum alloy suitably used for automotive brake parts for which wear resistance to sliding parts and viscosity during plastic deformation such as caulking are required, and to an extruded product obtained by extruding the aluminum alloy.

As an alloy generally used to secure wear resistance, an alloy in which hard Si particles are distributed in aluminum by adding a large amount of Si, such as a 4032 alloy specified in Japanese Industrial Standards (JIS) H4140, has been proposed. Japanese Patent Application Laid-open No. 9-176769 discloses an alloy in which extrudability and machinability are improved while maintaining wear resistance by adding Si, Mg, and Mn.

However, in the technical field of automotive brake parts and the like, in which wear resistance in lubricating oil such as brake fluid is necessary, compressive strength is required in addition to wear resistance. Moreover, viscosity of the material is necessary during caulking for assembling the parts.

A technology of depositing Si dispersion particles in the aluminum alloy by adding a large amount of Si, as described above, in order to improve wear resistance is known in the art.

However, viscosity of the metal material is decreased by dispersing Si particles in the alloy due to its notch effect.

Moreover, extrusion formability is decreased.

Therefore, not only extrusion productivity, but also viscosity is decreased in the aluminum alloy obtained by merely increasing the amount of Si added. Therefore, it is difficult to apply such an aluminum alloy to parts obtained by machining an extruded product of such an aluminum alloy and assembled with sliding parts such as a piston or valve, since such parts are relatively subjected to sliding wear and required to have compressive performance against lubricating oil sealed therein.

BRIEF SUMMARY OF THE INVENTION

According to one aspect of the present invention, there is provided a wear-resistant aluminum alloy excelling in caulking properties, comprising 0.1 to 0.39 wt % of Mg, 3.0 to 6.0 wt % of Si, 0.01 to 0.5 wt % of Cu, 0.01 to 0.5 wt % of Fe, 0.01 to 0.5 wt % of Mn, 0.01 to 0.5 wt % of Cr, and the remainder being Al and unavoidable impurities.

According to another aspect of the present invention, there is provided a wear-resistant aluminum extruded product excelling in caulking properties, comprising 0.1 to 0.39 wt % of Mg, 3.0 to 6.0 wt % of Si, 0.01 to 0.5 wt % of Cu, 0.01 to 0.5 wt % of Fe, 0.01 to 0.5 wt % of Mn, 0.01 to 0.5 wt % of Cr, and the remainder being Al and unavoidable impurities.

BRIEF DESCRIPTION OF THE SEVERAL VIEWS OF THE DRAWING

FIG. 1 (Table 1) is a table showing components of aluminum alloys according to the present invention.

FIG. 2 (Table 2) is a table showing extrusion conditions and heat treatment conditions for aluminum alloys according to the present invention.

FIG. 3 (Table 3) is a table showing evaluation results of an extruded product obtained by the present invention.

FIG. 4 (Table 4) is a table showing multiple regression analysis results.

DETAILED DESCRIPTION OF THE EMBODIMENT

Conventionally, viscosity and caulking properties of the aluminum alloy are decreased by improving wear resistance, and wear resistance and strength are decreased by improving caulking properties. Therefore, these properties are considered to be conflict with each other.

Figure 5:
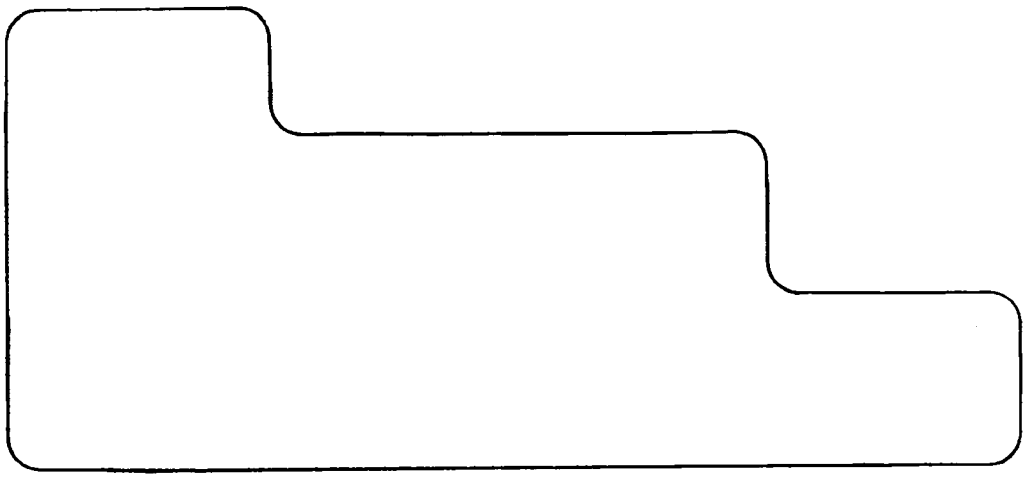
FIG. 5 shows a cross-sectional shape of an extruded product subjected to evaluation.

An extruded product as shown in FIG. 5 was formed by adding various components to an aluminum metal and extruding the aluminum alloy. Quality characteristics, extrudability, hardness, mechanical properties, and compressibility were evaluated by experiment.

As the first step, a wear resistance test was conducted in order to determine the amount of Si to be added for securing wear resistance necessary for an anti-lock braking system actuator body (hereinafter called "ABS body") which is an automotive brake part.

A wear resistance effect was recognized by adding 3.0 wt % of Si ("%" used hereinafter indicates "wt %"). The wear resistance effect was not further improved when adding Si in an amount of 6.0% or more. Therefore, the amount of Si to be added is suitably 3.0 to 6.0%, and preferably 3.5 to 5.5%.

If the amount of Si added is too great, extrudability is decreased. Therefore, the amount of Si to be added is ideally 3.5 to 5.0% taking extrudability into consideration.

The wear resistance was evaluated by relative comparison of results obtained under the following conditions.

A friction and wear tester ("EFM-III-F" manufactured by Orientec Co., Ltd.) was used.

As the test method, two cylindrical specimens (pin and specimen disk) are rotated along the center line, and friction and wear are caused to occur by pressing the pin against the disk while applying a constant load.

The pin was an SCr20 (carburized and quenched) material with a diameter of 5 mm and a height of 8 mm.

The specimen disk was cut from a T6-treated (T6 tempered) extruded material, and processed to have a diameter of 60 mm, height of 5 mm, surface roughness of 1.6 Z or less, and flatness of 0.01.

Brake fluid was used as lubricant. The rotational speed was 160 rpm, the test period was 50 hours, and the load was 20 MPa.

The amount of wear was measured by measuring the worn part of the specimen disk using a roughness measuring instrument.

Since strength cannot be secured by adding only Si, Mg is added in order to improve strength due to the precipitation effect of $Mg_2Si$. For example, the ABS body material must have hardness (evaluated by surface hardness) HRB (Rockwell B scale) of 35 or more, tensile strength of 240 MPa or more, and 0.2% yield strength of 190 MPa or more.

If the amount of Mg added is 0.6% or more, although strength can be secured, viscosity of the material is decreased. As a result, in the case of using such a material as the ABS body material, it is difficult to form a hole for allowing insertion of sliding parts such as a piston or valve and to perform caulking such as ball caulking. In the worst case, cracks occur in the ABS body material during caulking.

Caulking is described below.

Figure 7:
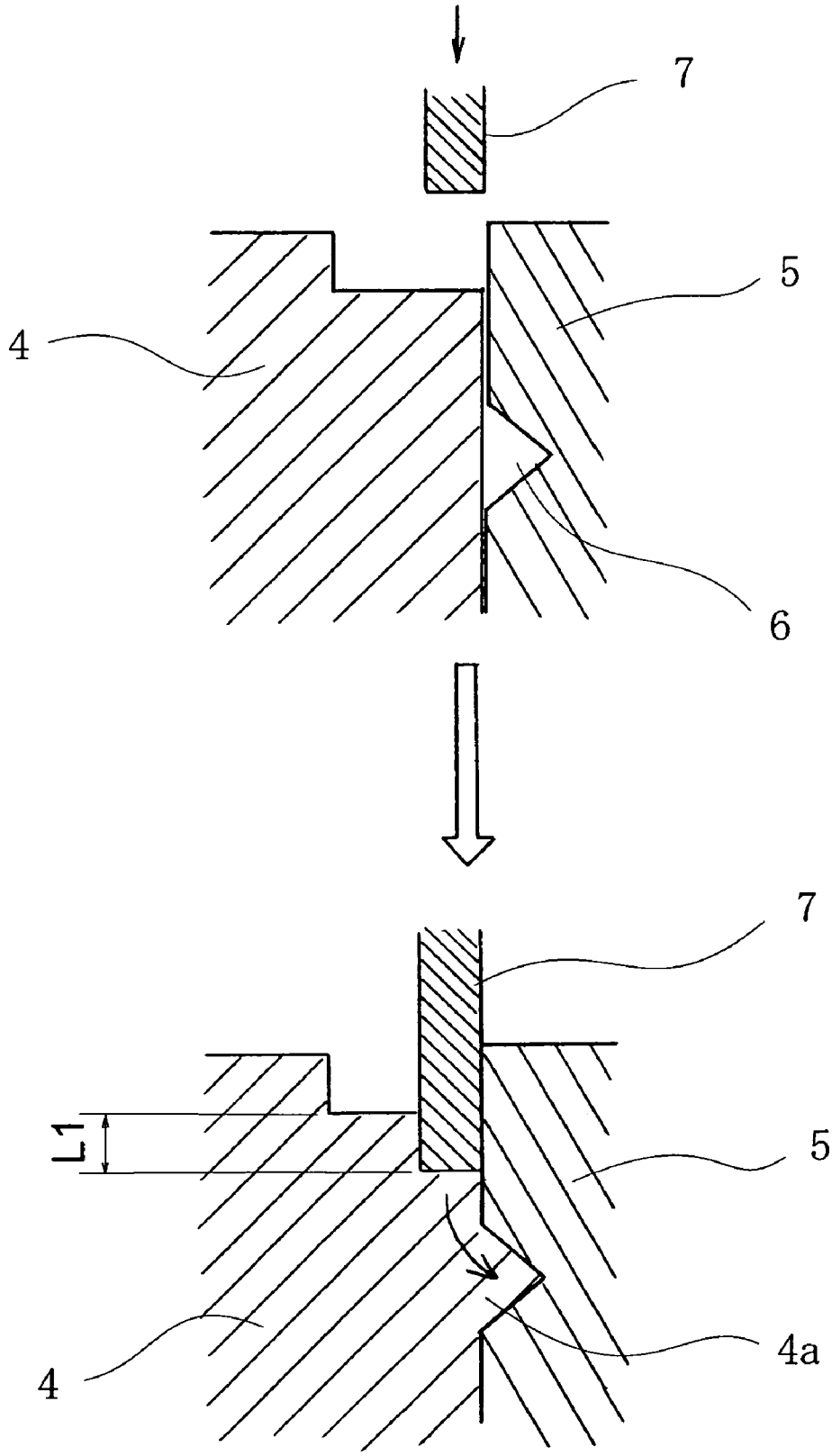
FIG. 7 shows an example in which a hollow 6 of an assembling part 5 is utilized to caulk an ABS body material 4 to the assembling part 5 by a punch 7.

An example shown in FIG. 7 illustrates a processing method in which an assembling part 5 provided with an assembling hollow 6 is secured to an ABS body material 4 using a jig or the like, and the metal of the ABS body material is caused to flow into the hollow 6 by pressing the ABS body material 4 from the side using a punch 7, whereby the ABS body material 4 is assembled on the assembling part 5.

A stroke L1 of the punch 7 is the caulking depth.

Figure 8:
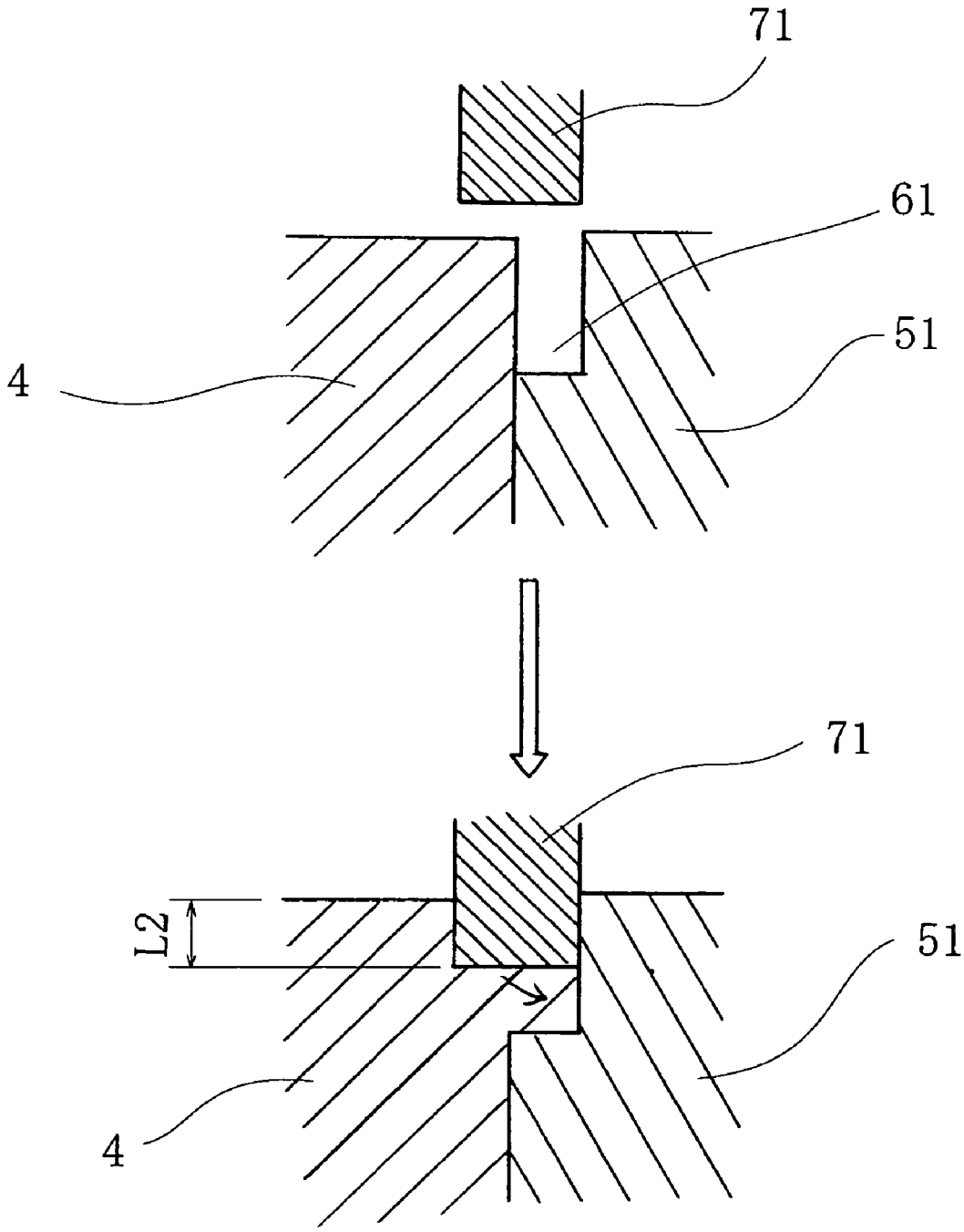
FIG. 8 shows an example in which an offset section 61 of an assembling part 51 is utilized to caulk an ABS body material 4 to the assembling parts 51 by a punch 71.

In an example shown in FIG. 8, an assembling part 51 provided with an offset section 61 is secured to the ABS body material 4 using a jig or the like, and the metal is caused to flow into the offset section 61 by pressing the ABS body material 4 from the side using a punch 71, whereby the ABS body material 4 is assembled on the assembling part 51.

A stroke L2 of the punch 71 is the caulking depth.

Figure 6:
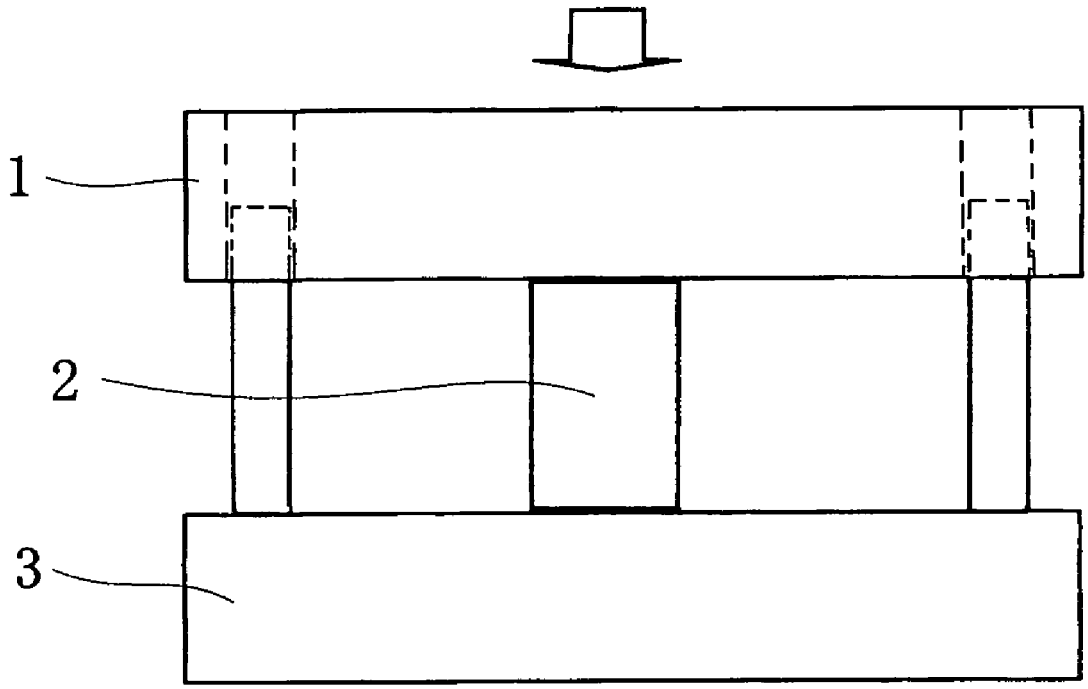
FIG. 6 is a schematic diagram for illustrating a method of testing the critical upsetting ratio. An upper mold is denoted by 1, and a lower mold is denoted by 3. A test specimen 2 is inserted between the upper mold 1 and the lower mold 3 to be compressed.

As the evaluation method for caulking properties, a test specimen 2 was placed between an upper mold 1 and a lower mold 3 as shown in FIG. 6, and a critical upsetting ratio at which microcracks occur in the test specimen when pressure is applied to the test specimen from the top was evaluated as compressibility. The component which influences quality characteristics was extracted by multiple regression analysis.

The results are shown in FIG. 4 (Table 4).

As is clear from these results, it was found that Mg and Mn have a considerable influence on the critical upsetting ratio. Therefore, the amount of these elements was examined while taking tensile strength and surface hardness into consideration.

A material to which Mg was added in an amount of 0.6% or more had a critical upsetting ratio, at which microcracks occur, of 40%. A material to which Mg was added in an amount of 0.5% had a critical upsetting ratio of 42%. A material to which Mg was added in an amount of 0.2% had a critical upsetting ratio of 50% or more.

The amount of Mg added has a negative correlation with the critical upsetting ratio. Therefore, in order to secure strength and caulking properties necessary for the ABS body material, the amount of Mg to be added is 0.1 to 0.45%, and preferably 0.2 to 0.45%.

Mn has a grain refinement effect. However, the amount of Mn added has a negative correlation with the critical upsetting ratio. Therefore, the amount of Mn to be added is suitably 0.01 to 0.5%, and preferably 0.01 to 0.3%.

Cu contributes to a solid-solution effect in aluminum and improves hardness. However, corrosion resistance is decreased if the amount of Cu added is too great. Therefore, Cu is suitably added in an amount of 0.01 to 0.5%.

Cr, Fe, and Ti have a grain refinement effect. These elements are arbitrarily added.

The practical ranges for Cr, Fe, and Ti are respectively 0.01 to 0.5%, 0.01 to 0.5%, and 0.01 to 0.2%.

An eight-inch billet having an alloy composition shown in FIG. 1 (Table 1) was cast. As shown in FIG. 2 (Table 2), the billet was subjected to a homogenization treatment at 460 to 590° C. for six hours or more, and hot-extruded at 450 to 510° C.

As a T6 treatment, the hot-extruded product was quenched at the die end immediately after extrusion, and subjected to an artificial aging treatment by performing a heat treatment at 160 to 195° C. for 2 to 8 hours.

The extruded product was formed into the shape shown in FIG. 5. Extrudability of the resulting extruded product was evaluated.

The extruded product after artificial aging was cut to 90 mm. Hardness, mechanical properties, and compressibility as substitution evaluation for caulking properties were evaluated according to the following test methods.

(1) The maximum extrusion rate at which the product can be extruded without causing cracks to occur on the surface of the hot-extruded product was measured. Extrudability of each alloy was evaluated according to the maximum extrusion rate.

(2) The surface hardness of the T6-treated extruded product was evaluated using a Rockwell B scale hardness tester.

(3) A tensile test specimen specified in JIS 13B was collected from the T6-treated extruded product, and tested according to JIS Z2241.

(4) Compressibility was evaluated using a cold upsettability test method.

The end restraint upsetting test of a cylindrical test specimen was conducted.

A test specimen with a diameter of 14 mm and a height of 21 mm was collected from the T6-treated extruded product in the extrusion direction. The test specimen was subjected to cold upsetting pressing in the axial direction, and the critical upsetting ratio at which microcracks occurred on the side surface was calculated.

The critical upsetting ratio was calculated according to the following equation.

$$\epsilon hc=(h0-hc)/h0\times 100$$

$\epsilon$hc indicates the critical upsetting ratio (%), h0 indicates the original height of the test specimen, and hc indicates the height of the test specimen when cracks occurred.

The test was conducted at room temperature and a compression speed of 10 mm/s. An autograph (25 t) was used as the test instrument.

The evaluation results obtained by the above method are shown in FIG. 3 (Table 3).

As a result, as opposed to a conventional wear-resistant alloy J evaluated as a comparative example, a novel aluminum alloy exhibiting wear resistance and compressibility (caulking properties) while improving extrudability and its extruded product can be obtained by setting the Mg content at 0.1 to 0.45 wt %, the Cu content at 0.01 to 0.5 wt % and preferably 0.01 to 0.2 wt %, the Si content at 3.0 to 6.0 wt %, and the Mn content at 0.01 to 0.5 wt % and preferably 0.01 to 0.3 wt %.

The aluminum alloy according to the present invention excels in extrudability in comparison with a conventional wear-resistant alloy. The extruded product obtained by using the aluminum alloy exhibits wear resistance, strength, hardness, and caulking properties (or viscosity), which have been considered to conflict with these properties. Therefore, the aluminum alloy and the extruded product can be used as an aluminum alloy and an extruded product used for products for which wear resistance, compressive strength, and caulking properties during production working are required.

What is claimed is:

1. A wear-resistant aluminum alloy excelling in caulking properties, comprising 0.1 to 0.39 wt % of Mg, 3.0 to 6.0 wt % of Si, 0.01 to 0.20 wt % of Cu, 0.01 to 0.5 wt % of Fe, 0.01 to 0.15 wt % of Mn, 0.01 to 0.5 wt % of Cr, less than 0.02 wt % of Zn, and the remainder being Al and unavoidable impurities;

wherein a critical upsetting ratio of the alloy is greater than or equal to 43%; and wherein $0.79\cdot(\text{wt \% of Mn})+0.26\cdot(\text{wt \% of Mg})\leqq 0.22$.

2. A wear-resistant aluminum extruded product excelling in caulking properties, comprising 0.1 to 0.39 wt % of Mg, 3.0 to 6.0 wt % of Si, 0.01 to 0.20 wt % of Cu, 0.01 to 0.5 wt % of Fe, 0.01 to 0.5 wt % of Mn, 0.01 to 0.5 wt % of Cr, less than 0.02 wt % of Zn, and the remainder being Al and unavoidable impurities;

wherein a critical upsetting ratio of the extruded product is greater than or equal to 43%; and wherein $0.79(\text{wt \% of Mn})+0.26\cdot(\text{wt \% of Mg})\leqq 0.22$.

* * * * *